US009667008B2

(12) United States Patent
Hsieh

(10) Patent No.: US 9,667,008 B2
(45) Date of Patent: May 30, 2017

(54) POWER ADAPTOR

(71) Applicant: DELTA ELECTRONICS, INC., Taoyuan (TW)

(72) Inventor: Hung-Sheng Hsieh, Taoyuan (TW)

(73) Assignee: Delta Electronics, Inc., Taoyuan (TW)

( * ) Notice: Subject to any disclaimer, the term of this patent is extended or adjusted under 35 U.S.C. 154(b) by 0 days.

(21) Appl. No.: 14/933,800

(22) Filed: Nov. 5, 2015

(65) Prior Publication Data

US 2016/0344149 A1 Nov. 24, 2016

(30) Foreign Application Priority Data

May 22, 2015 (TW) ..... 104116373 A

(51) Int. Cl.

| | |
|---|---|
| ***H01R 29/00*** | (2006.01) |
| ***H01R 31/06*** | (2006.01) |
| ***H01R 27/00*** | (2006.01) |
| ***H01R 27/02*** | (2006.01) |
| *H01R 13/64* | (2006.01) |
| *H01R 13/66* | (2006.01) |

(52) U.S. Cl.

CPC ..... *H01R 31/06* (2013.01); *H01R 27/00* (2013.01); *H01R 27/02* (2013.01); *H01R 29/00* (2013.01); *H01R 13/64* (2013.01); *H01R 13/6675* (2013.01)

(58) Field of Classification Search

CPC ..... H01R 24/66; H02R 27/00; H02R 31/06
USPC ..... 439/518, 955, 956, 638
See application file for complete search history.

(56) References Cited

U.S. PATENT DOCUMENTS

| | | | | |
|---|---|---|---|---|
| 3,996,546 | A * | 12/1976 | Hugly | H01R 27/00 336/107 |
| 6,664,758 | B2 * | 12/2003 | Yang | H02J 7/0006 320/107 |
| 6,741,064 | B2 * | 5/2004 | Liu | H02J 7/0042 307/64 |
| 8,033,847 | B1 | 10/2011 | Chen | |
| 8,149,570 | B2 * | 4/2012 | Keebler | H02J 7/0055 307/11 |
| 8,558,516 | B2 * | 10/2013 | Takahashi | H02J 7/00 320/158 |
| 2003/0122523 | A1 | 7/2003 | Kim et al. | |
| 2005/0219882 | A1 | 10/2005 | Wu | |
| 2009/0096294 | A1 | 4/2009 | Youn et al. | |
| 2011/0157939 | A1 | 6/2011 | Wang et al. | |
| 2012/0100733 | A1 | 4/2012 | Lee et al. | |
| 2012/0139511 | A1 | 6/2012 | Chou et al. | |

(Continued)

FOREIGN PATENT DOCUMENTS

| | | | |
|---|---|---|---|
| TW | 201131925 | A1 | 9/2011 |
| TW | 201414123 | A | 4/2014 |
| WO | WO 2012/030397 | A1 | 3/2012 |

*Primary Examiner* — Phuong Dinh

(74) *Attorney, Agent, or Firm* — Muncy, Geissler, Olds & Lowe, P.C.

(57) ABSTRACT

A power adaptor includes an adaptor body, an output connector, and a replaceable tip. The output connector is connected to the adaptor body. The replaceable tip is detachably connected to the output connector. The replaceable tip includes four terminals, a first conductive element, and a second conductive element. The first conductive element is connected to two or three of the terminals. The second conductive element is connected to at least one of the remaining terminals. The adaptor body outputs an output voltage depending on the replaceable tip.

8 Claims, 4 Drawing Sheets

(56) References Cited

U.S. PATENT DOCUMENTS

| | | | |
|---|---|---|---|
| 2014/0030936 | A1 | 1/2014 | Sandoval et al. |
| 2014/0085756 | A1 | 3/2014 | Lin et al. |

* cited by examiner

POWER ADAPTOR

CROSS REFERENCE TO RELATED APPLICATIONS

This Non-provisional application claims priority under 35 U.S.C. §119(a) on Patent Application No(s). 104116373 filed in Taiwan, Republic of China on May 22, 2015, the entire contents of which are hereby incorporated by reference.

BACKGROUND OF THE INVENTION

Field of Invention

The invention relates to a power adaptor.

Related Art

In the era of vigorous development of portable electronic devices, most people may have a plurality of portable electronic devices at the same time such as mobile phones, tablet computers, cameras, event data recorders, and the like. Various kinds of electronic devices generally utilize batteries of different voltages. For example, a 5 V battery is utilized in a mobile phone, and a 19 V battery is utilized in a laptop. Each electronic device is equipped with its own power adaptor to adjust utility power to the appropriate voltage for charging.

Power adaptors of various kinds of electronic devices output various voltages, so they cannot be utilized interchangeably. Accordingly, when users carry electronic devices of distinct voltages at the same time, they also need to carry a plurality of power adaptors of various output voltages so as to charge respectively. Therefore, it is inconvenient for users to carry and use.

SUMMARY OF THE INVENTION

A power adaptor according to the invention includes an adaptor body, an output connector, and a replaceable tip. The output connector is connected to the adaptor body. The replaceable tip is detachably connected to the output connector. The replaceable tip includes four terminals, a first conductive element, and a second conductive element. The first conductive element is connected to two or three of the terminals. The second conductive element is connected to at least one of the remaining terminals. The adaptor body outputs an output voltage depending on the replaceable tip.

In one embodiment, the first conductive element is connected to two of the terminals, and the second conductive element is connected to the two remaining terminals.

In one embodiment, the terminals are a positive electric terminal, a negative electric terminal, a positive reference terminal, and a negative reference terminal. When the first conductive element is connected to the positive electric terminal and the positive reference terminal and the second conductive element is connected to the negative electric terminal and the negative reference terminal, the output voltage is a first voltage level.

In one embodiment, the terminals are a positive electric terminal, a negative electric terminal, a positive reference terminal, and a negative reference terminal. When the first conductive element is connected to the positive electric terminal and the negative reference terminal and the second conductive element is connected to the negative electric terminal and the positive reference terminal, the output voltage is a second voltage level.

In one embodiment, the first conductive element is connected to three of the terminals, and the second conductive element is connected to the remaining terminal.

In one embodiment, the terminals are a positive electric terminal, a negative electric terminal, and two reference terminals. When the first conductive element is connected to the positive electric terminal and the reference terminals and the second conductive element is connected to the negative electric terminal, the output voltage is a third voltage level.

In one embodiment, the terminals are a positive electric terminal, a negative electric terminal, and two reference terminals. When the first conductive element is connected to the negative electric terminal and the reference terminals and the second conductive element is connected to the positive electric terminal, the output voltage is a fourth voltage level.

In one embodiment, the output connector has four contact openings, and the terminals are respectively inserted into the contact openings.

A power adaptor according to the invention includes an adaptor body, an output connector, and a replaceable tip. The output connector is connected to the adaptor body. The replaceable tip is detachably connected to the output connector. The replaceable tip includes two conductive elements, two electric terminals, and two reference terminals. Each conductive element is one on one connected to each electric terminal. The reference terminals are connected to the same conductive element or respectively connected to the different conductive elements. The adaptor body outputs an output voltage depending on the replaceable tip.

In one embodiment, when the reference terminals are respectively connected to the different conductive elements, the conductive elements are respectively connected to one of the electric terminals and one of the reference terminals.

In one embodiment, the electric terminals are a positive electric terminal and a negative electric terminal, and the reference terminals are a positive reference terminal and a negative reference terminal. When one of the conductive elements is connected to the positive electric terminal and the positive reference terminal and the other conductive element is connected to the negative electric terminal and the negative reference terminal, the output voltage is a first voltage level.

In one embodiment, the electric terminals are a positive electric terminal and a negative electric terminal, and the reference terminals are a positive reference terminal and a negative reference terminal. When one of the conductive elements is connected to the positive electric terminal and the negative reference terminal and the other conductive element is connected to the negative electric terminal and the positive reference terminal, the output voltage is a second voltage level.

In one embodiment, when the reference terminals are connected to the same conductive element, one of the conductive elements is connected to one of the electric terminals and the two reference terminals, and the other conductive element is connected to the other terminal.

In one embodiment, the electric terminals are a positive electric terminal and a negative electric terminal. When one of the conductive elements is connected to the positive electric terminal and the reference terminals and the other conductive element is connected to the negative electric terminal, the output voltage is a third voltage level.

In one embodiment, the electric terminals are a positive electric terminal and a negative electric terminal. When one of the conductive elements is connected to the negative electric terminal and the reference terminals and the other conductive element is connected to the positive electric terminal, the output voltage is a fourth voltage level.

In one embodiment, the output connector has four contact openings, and the electric terminals and the reference terminals are respectively inserted into the contact openings.

A power adaptor according to the invention includes an adaptor body, an output connector, and a replaceable tip. The output connector is connected to the adaptor body. The replaceable tip is detachably connected to the output connector. The replaceable tip includes two reference terminals and two electric terminals. One of the electric terminals is connected to at least one of the reference terminals. The adaptor body outputs an output voltage depending on the replaceable tip.

In one embodiment, one of the electric terminals is connected to one of the reference terminals, and the other electric terminal is connected to the other reference terminal.

In one embodiment, the reference terminals are a positive reference terminal and a negative reference terminal, and the electric terminals are a positive electric terminal and a negative electric terminal. When the positive electric terminal is connected to the positive reference terminal and the negative electric terminal is connected to the negative reference terminal, the output voltage is a first voltage level.

In one embodiment, the reference terminals are a positive reference terminal and a negative reference terminal, and the electric terminals are a positive electric terminal and a negative electric terminal. When the positive electric terminal is connected to the negative reference terminal and the negative electric terminal is connected to the positive reference terminal, the output voltage is a second voltage level.

In one embodiment, one of the electric terminals is connected to the two reference terminals.

In one embodiment, the electric terminals are a positive electric terminal and a negative electric terminal. When the positive electric terminal is connected to the reference terminals, the output voltage is a third voltage level.

In one embodiment, the electric terminals are a positive electric terminal and a negative electric terminal. When the negative electric terminal is connected to the reference terminals, the output voltage is a fourth voltage level.

In one embodiment, the output connector has four contact openings, and the electric terminals and the reference terminals are respectively inserted into the contact openings.

As mentioned above, as to the power adaptor of the invention, various configurations of terminals shorted by conductive elements allow the adaptor body accordingly to output the output voltages of various voltage levels. To change the voltage level of the output voltage, it is only necessary to replace the replaceable tip, and then the adaptor body can output the output voltages of different voltage levels depending on the short-circuit configuration of the terminals of the different replaceable tips, so that various electronic devices can share one power adaptor.

BRIEF DESCRIPTION OF THE DRAWINGS

The invention will become more fully understood from the detailed description and accompanying drawings, which are given for illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
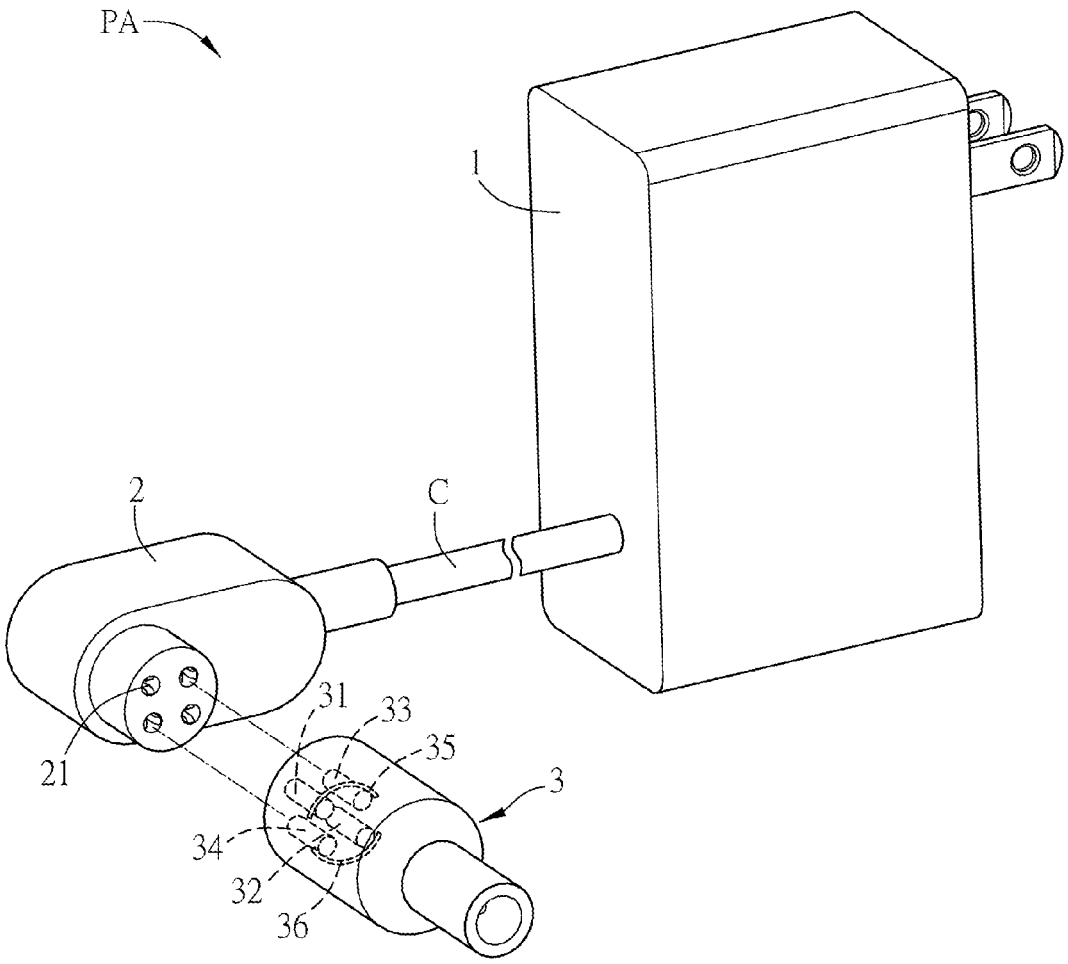
FIG. 1 is a schematic diagram of a power adaptor according to a preferred embodiment of the invention.

FIG. 1 is a schematic diagram of a power adaptor according to a preferred embodiment of the invention. Referring to FIG. 1, the power adaptor PA may be applied to portable electronic products such as mobile phones, smart phones, personal digital assistants (PDA), digital cameras, digital camcorders, event data recorders, tablet computers, laptops, mobile power packs, wearable devices, and the like. The power adaptor PA includes an adaptor body 1, an output connector 2, and a replaceable tip 3. The output connector 2 is connected to the adaptor body 1, for example through a cable C, and the replaceable tip 3 is detachably connected to the output connector 2.

In the embodiment, the replaceable tip 3 includes four terminals which are two electric terminals and two reference terminals, and the output connector 2 has four contact openings 21. Terminals are respectively inserted into the contact openings 21, and the size of each terminal matches that of each contact opening 21. In detail, the electric terminals include the positive electric terminal 31 and the negative electric terminal 32, and the reference terminals include the positive reference terminal 33 and the negative reference terminal 34. The four terminals may individually exhibit cylindrical shape, sheet-like shape, or other shapes, or they exhibit the combination of the above shapes. The cylindrical shape is taken for example in the embodiment. Here, the adaptor body 1 outputs electrical signals to the positive electric terminal 31 and the negative electric terminal 32 as the power supply of the portable electronic products.

Figure 2:
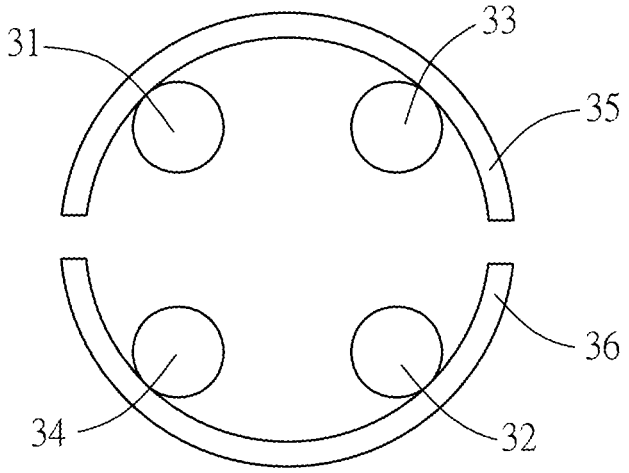
FIG. 2 is a schematic diagram of the connection between the terminals and the conductive elements.

The replaceable tip 3 further includes a first conductive element 35 and a second conductive element 36. Referring to FIGS. 1 and 2, FIG. 2 is a schematic diagram of the connection between the terminals and the conductive elements. The first conductive element 35 is connected to two or three of the terminals, and the second conductive element 36 is connected to at least one of the remaining terminals. It should be noted that the "connection" between the conductive element and the terminal described herein refers to the physical connection. Therefore, when a voltage is provided for the conductive element and the terminal which are connected to each other, the conductive element and the terminal are at the same voltage level.

Subsequently, in the embodiment, the first conductive element 35 and the second conductive element 36 are respectively connected to two terminals. The first conductive element 35 is connected to the positive electric terminal 31 and the positive reference terminal 33, and the second conductive element 36 is connected to the negative electric terminal 32 and the negative reference terminal 34. As a result, the positive electric terminal 31 and the positive reference terminal 33 are shorted by the first conductive element 35 to form a live wire, and the negative electric terminal 32 and the negative reference terminal 34 are shorted by the second conductive element 36 to form a neutral wire. Here, the adaptor body 1 may output an output voltage depending on the replaceable tip 3.

In detail, the adaptor body 1 has a determination unit (not shown in figures) inside which may be a logic circuit or a microprocessor. The determination unit is electrically connected to the four terminals mentioned above, and it can change the voltage level of the output voltage depending on the physically connecting condition of the terminals. In the embodiment, when detecting that the positive electric terminal 31 and the positive reference terminal 33 are shorted (i.e. electric potentials are equal) and the negative electric terminal 32 and the negative reference terminal 34 are shorted, the determination unit will assign the first voltage level to the output voltage of the adaptor body 1, for example 12 V. Therefore, the power adaptor PA may charge the electronic products adapted to 12 V (e.g. laptops) at this time.

Figure 3:
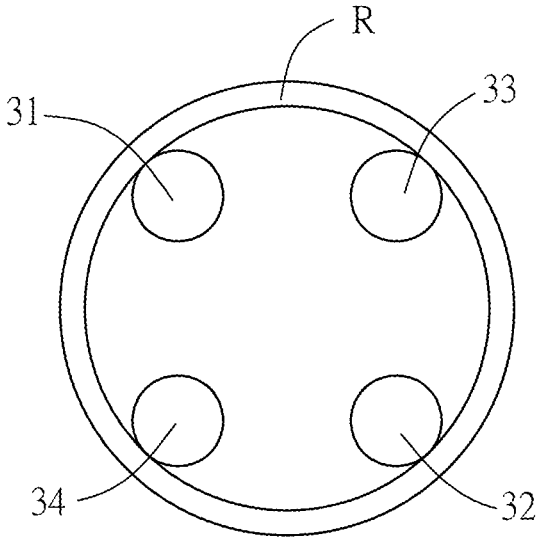
FIG. 3 is a schematic diagram of the manufacturing process of the replaceable tip.

Referring to FIG. 3, it is a schematic diagram of the manufacturing process of the replaceable tip. In the production, the terminals (for example four terminals) may be individually physically connected to a conductive ring R, for example, by welding. The axis of each terminal is parallel to that of the conductive ring R, and the intervals between the adjacent terminals may be the same. At this time, four terminals and the conductive ring R are integrated as one single component, and the terminals are arranged in the order of the positive electric terminal 31, the positive reference terminal 33, the negative electric terminal 32, and the negative reference terminal 34. That is to say, the electric terminals and the reference terminals are alternately circumferentially arranged.

Subsequently, the conductive ring R is cut and separated into at least two components (namely the foresaid first conductive element and second conductive element). Furthermore, the cutting position of the conductive ring R is located between the terminals, and at least two cutting positions exist. In the embodiment, the two cutting positions of the conductive ring R are respectively located between the positive electric terminal 31 and the negative reference terminal 34 and between the positive reference terminal 33 and the negative reference terminal 34. As a result, the positive electric terminal 31 and the positive reference terminal 33 may be shorted by the first conductive element 35, and the negative electric terminal 32 and the negative reference terminal 34 may be shorted by the second conductive element 36. Finally, the structure of the terminals and the conductive elements described above is wrapped by injection and form the replaceable tip 3, and at least the four terminals described above are exposed outside to be inserted and connected to the output connector 2. Here, when the above replaceable tip 3 and output connector 2 are connected, the adaptor body 1 may output the output voltage of the first voltage level depending on the short-circuit configuration of described above.

Figure 4A:
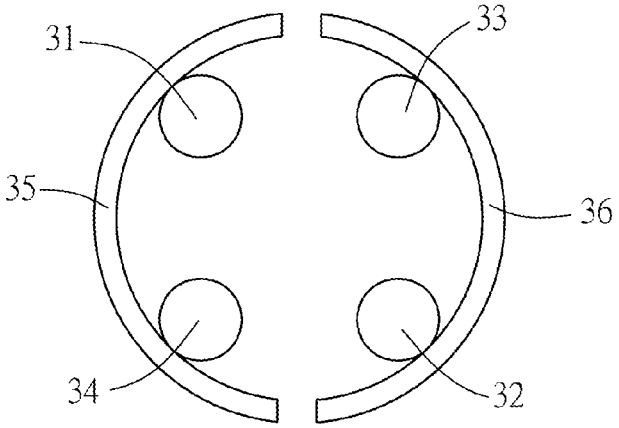
FIGS. 4A to 4C are respectively schematic diagrams of the combinations of the terminals and the conductive elements.
Figure 4B:
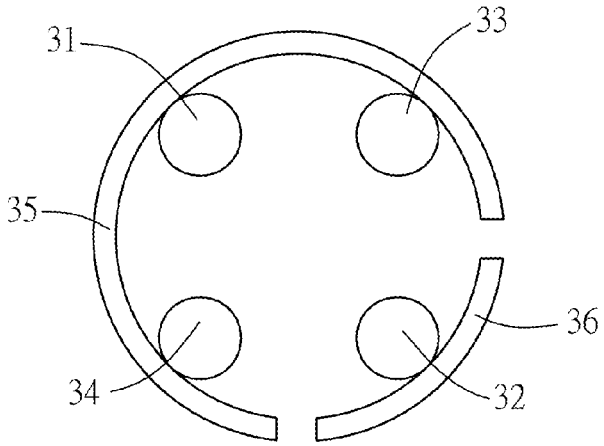
Figure 4C:
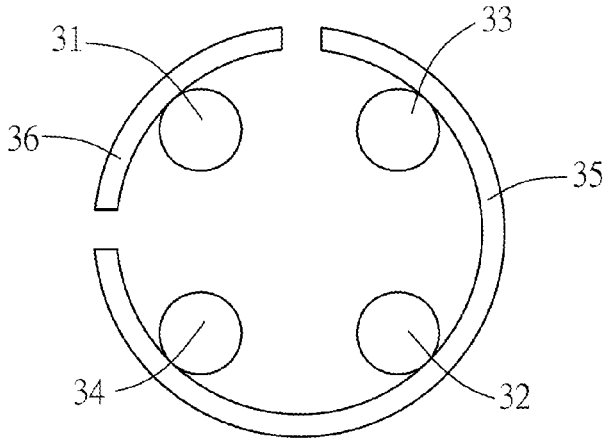

In practice, the location of the cutting position of the conductive ring R may depend on the requirement of the product. Thus, there are various short-circuit configurations between the electric terminals and the reference terminals. The short-circuit configurations of the electric terminals and the reference terminals are described with FIGS. 4A to 4C as follows. FIGS. 4A to 4C are respectively schematic diagrams of the combinations of the terminals and the conductive elements.

In FIG. 4A, the cutting positions of the conductive ring R are located between the positive electric terminal 31 and the positive reference terminal 33 and between the negative electric terminal 32 and the negative reference terminal 34. Therefore, the conductive ring R is cut into the first conductive element 35 and the second conductive element 36, the positive electric terminal 31 and the negative reference terminal 34 are connected through the first conductive element 35 and form a live wire, and the negative electric terminal 32 and the positive reference terminal 33 are connected through the second conductive element 36 and form a neutral wire. When the replaceable tip 3 is connected to the output connector 2, the adaptor body 1 will output the output voltage of the second voltage level depending on this short-circuit configuration.

In FIG. 4B, the cutting positions of the conductive ring R are located between the negative electric terminal 32 and the positive reference terminal 33 and between the negative electric terminal 32 and the negative reference terminal 34. Therefore, the conductive ring R is cut into the first conductive element 35 and the second conductive element 36. The positive electric terminal 31, the positive reference terminal 33, and the negative reference terminal 34 are connected through the first conductive element 35 and form a live wire, and the second conductive element 36 is only connected to the negative electric terminal 32 and form a neutral wire. In other words, the first conductive element 35 is connected to three terminals, and the second conductive element 36 is connected to one terminal. Moreover, when the replaceable tip 3 is connected to the output connector 2, the adaptor body 1 will output the output voltage of the third voltage level depending on this short-circuit configuration.

In FIG. 4C, the cutting positions of the conductive ring R are located between the positive electric terminal 31 and the positive reference terminal 33 and between the positive electric terminal 31 and the negative reference terminal 34. Therefore, the conductive ring R is cut into the first conductive element 35 and the second conductive element 36. The positive electric terminal 31 and the second conductive element 36 are connected and form a live wire. The negative electric terminal 32, the positive reference terminal 33, and the negative reference terminal 34 are connected through the first conductive element 35 and form a neutral wire. When the replaceable tip 3 is connected to the output connector 2, the adaptor body 1 will output the output voltage of the fourth voltage level depending on this short-circuit configuration.

Therefore, according to the numbers of the reference terminals which are connected respectively to the positive electric terminal 31 and the negative electric terminal 32 through the conductive elements, the power adaptor PA outputs the output voltages of different voltage levels. Thus, only a suitable replaceable tip 3 is necessarily substituted in the same power adaptor PA to adapt to the electronic devices of different voltages, so that various electronic devices can share one power adaptor. It is convenient for a user to carry and easily use.

In some embodiments, the dimensions of each terminal may not be completely the same to act as a poka-yoke mechanism. For example, the radial dimension or the axial dimension of the positive electric terminal 31 is relatively large, the dimensions of the other three terminals are all equal, and the contact openings 21 are correspondingly matched. Therefore, when a user assembles the replaceable tip 3 and the output connector 2, the inadvertent misplacement of the terminals into the uncorresponding contact openings 21 can be avoided, and the damage of the electronic device caused by that the output voltage is not equal to the required voltage of the electronic device will not occur. Moreover, the poka-yoke mechanism may also be realized by disposing a concave-convex structure for positioning on the end surfaces where the replaceable tip 3 and the output connector 2 are connected. Certainly, because the methods for preventing misplacement by a user during assembling are numerous, only two examples are named above, but the invention is not limited thereto.

Furthermore, although four terminals are respectively shorted by the conductive elements to form the live wire and the neutral wire, the invention is not limited thereto. In other embodiments, the number of the terminals may be four or more. Taking five terminals for example, two electric terminals and three reference terminals are included and arranged for more short-circuit configurations to allow the adaptor body 1 to output the output voltages of more kinds of voltage levels.

Moreover, in some embodiments, the positive electric terminal 31 can be connected to only one reference terminal to form a live wire, the negative electric terminal 32 is a neutral wire, and the other reference terminal is not connected to other terminals to be electrically floating or act as ground. The adaptor body 1 outputs the output voltage of the fifth voltage level depending on this short-circuit configuration. Alternatively, the positive electric terminal 31 and the negative electric terminal 32 may be interchanged, then the adaptor body 1 outputs the output voltage of the sixth voltage level, and it is not repeated here.

In other embodiments, one of the electric terminals may be directly connected to at least one of the reference terminal. That is to say, they are not connected through the conductive element. In practice, when the replaceable tip 3 which provides the output voltage of the first voltage level is produced, namely when the short-circuit configuration that the positive electric terminal 31 and the positive reference terminal 33 are connected to form a live wire and the negative electric terminal 32 and the negative reference terminal 34 are connected to form a neutral wire occurs, for example, two U-shaped metal elements which are separated and not connected may be provided and wrapped by injection to form the replaceable tip 3. At this time, the two ends of one U-shaped metal element are respectively defined as the positive electric terminal 31 and the positive reference terminal 33, and the two ends of the other U-shaped metal element are respectively defined as the negative electric terminal 32 and the negative reference terminal 34, so that the adaptor body 1 can output the output voltage of the first voltage level when the output connector 2 is connected to the replaceable tip 3. Similarly, an m-shaped metal element and an electric terminal are wrapped together by injection, and then the replaceable tip 3 having the output voltage of the third voltage level or the fourth voltage level can be produced. Other short-circuit configuration may be also obtained by reference to this manufacturing method, which should be understood by a person having ordinary skill in the art, and it is not described here. Here, in the step of providing a U-shaped or m-shaped metal element, for example, two terminals are connected by welding one end of each terminal to form the U-shape, or three terminals are connected by welding one end of each terminal to form the m-shape. It can also be an integrated U-shaped or m-shaped metal element, and it is not limited thereto.

Figure 5:
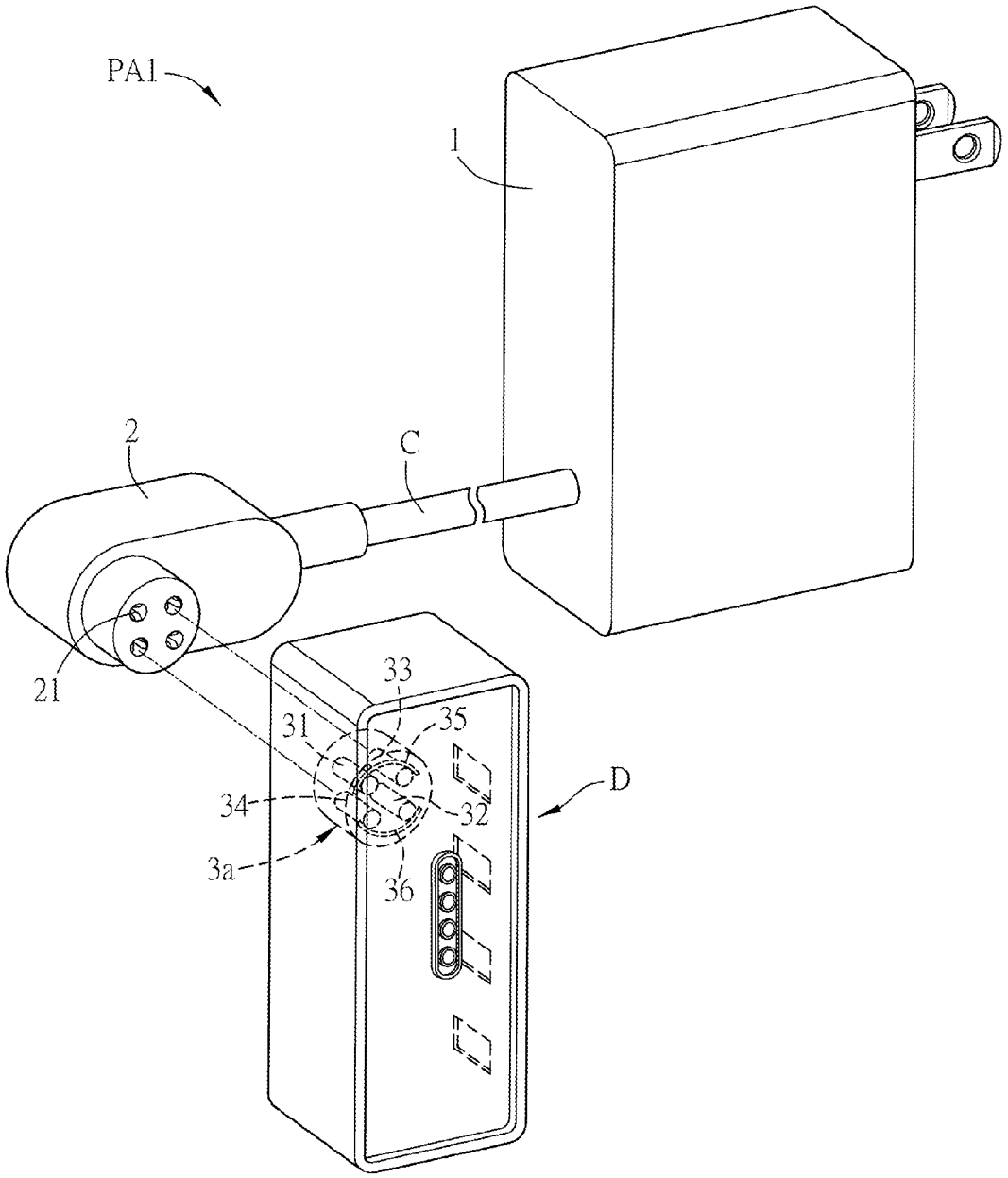
FIG. 5 is a schematic diagram of the application of a power adaptor according to a preferred embodiment of the invention.

Finally, referring to FIG. 5, it is a schematic diagram of the application of a power adaptor according to a preferred embodiment of the invention. The replaceable tip 3*a* of the power adaptor PA1 is integrated into the electronic device D. That is to say, the electronic device D and the replaceable tip 3*a* are integrated as one single component. In the embodiment, the replaceable tip 3*a* is embedded in the electronic device D. The electronic device D may be a mobile phone, a tablet computer, a camera, an event data recorder, a network sharing device, a mobile power pack, a hub, or the like. A USB hub is taken for example in the embodiment. The technical features and the mutual connecting relationship of the above power adaptor and the replaceable tip thereof are described in detail in the above embodiments, and they are not repeated here. Therefore, the adaptor body 1 may output the output voltages of different voltage levels depending on different short-circuit configuration of the terminals by designing the terminals of the replaceable tip 3*a*, so that various electronic devices can share one power adaptor.

It should be noted that, in all embodiments, different aspects of each element, component, or unit may be interchangeably used in every embodiment, and they are not limited to the aspects named in the above embodiments.

In summary, as to the power adaptor of the invention, various configurations of terminals shorted by conductive elements allow the adaptor body accordingly to output the output voltages of various voltage levels. To change the voltage level of the output voltage, it is only necessary to replace the replaceable tip, and then the adaptor body can output the output voltages of different voltage levels depending on the short-circuit configuration of the terminals of the different replaceable tips, so that various electronic devices can share one power adaptor.

Although the present invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the present invention.

What is claimed is:

1. A power adaptor, comprising:

an adaptor body;

an output connector, connected to the adaptor body; and a replaceable tip, detachably connected to the output connector, wherein the replaceable tip comprises:

four terminals;

a first conductive element, connected to two of the terminals; and a second conductive element, connected to two of the remaining terminals;

wherein the adaptor body outputs an output voltage depending on the replaceable tip.

2. The power adaptor of claim 1, wherein the terminals are a positive electric terminal, a negative electric terminal, a positive reference terminal, and a negative reference terminal, when the first conductive element is connected to the positive electric terminal and the positive reference terminal and the second conductive element is connected to the negative electric terminal and the negative reference terminal, the output voltage is a first voltage level.

3. The power adaptor of claim 1, wherein the terminals are a positive electric terminal, a negative electric terminal, a positive reference terminal, and a negative reference terminal, when the first conductive element is connected to the positive electric terminal and the negative reference terminal and the second conductive element is connected to the negative electric terminal and the positive reference terminal, the output voltage is a second voltage level.

4. The power adaptor of claim 1, wherein the output connector has four contact openings, and the terminals are respectively inserted into the contact openings.

5. A power adaptor, comprising:

an adaptor body;

an output connector, connected to the adaptor body; and a replaceable tip, detachably connected to the output connector, wherein the replaceable tip comprises:

two conductive elements;

two electric terminals, wherein each conductive element is one on one connected to each electric terminal; and two reference terminals, connected to the same one of the conductive elements;

wherein the adaptor body outputs an output voltage depending on the replaceable tip, one of the conductive elements is connected to one of the electric terminals and the two reference terminals, and the other conductive element is connected to the other electric terminal.

6. The power adaptor of claim 5, wherein the electric terminals are a positive electric terminal and a negative electric terminal, when one of the conductive elements is connected to the positive electric terminal and the reference teiininals and the other conductive element is connected to the negative electric terminal, the output voltage is a third voltage level, and when one of the conductive elements is connected to the negative electric terminal and the reference terminals and the other conductive element is connected to the positive electric terminal, the output voltage is a fourth voltage level.

7. A power adaptor, comprising:

an adaptor body;

an output connector, connected to the adaptor body; and a replaceable tip, detachably connected to the output connector, wherein the replaceable tip comprises:

two reference terminals; and two electric terminals, wherein one of the electric terminals is connected to at least one of the reference terminals;

wherein the adaptor body outputs an output voltage depending on the replaceable tip, and one of the electric terminals is connected to the two reference terminals.

8. The power adaptor of claim 7, wherein the electric terminals are a positive electric terminal and a negative electric terminal, when the positive electric terminal is connected to the reference terminals, the output voltage is a third voltage level, and when the negative electric terminal is connected to the reference terminals, the output voltage is a fourth voltage level.

* * * * *